US008722594B2

(12) United States Patent
Yagishita

(10) Patent No.: US 8,722,594 B2
(45) Date of Patent: May 13, 2014

(54) LUBRICATING OIL COMPOSITION

(75) Inventor: Kazuhiro Yagishita, Kanagawa (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 0 days.

(21) Appl. No.: 13/583,702

(22) PCT Filed: Feb. 23, 2011

(86) PCT No.: PCT/JP2011/053966

§ 371 (c)(1),
(2), (4) Date: Sep. 10, 2012

(87) PCT Pub. No.: WO2011/114848

PCT Pub. Date: Sep. 22, 2011

(65) Prior Publication Data

US 2013/0005625 A1 Jan. 3, 2013

(30) Foreign Application Priority Data

Mar. 19, 2010 (JP) ..... 2010-064869
Mar. 26, 2010 (JP) ..... 2010-073475

(51) Int. Cl.
*C10M 137/10* (2006.01)
*F16C 33/20* (2006.01)
*C10M 159/24* (2006.01)

(52) U.S. Cl.
USPC ..... 508/371; 508/370; 508/100; 508/391

(58) Field of Classification Search
CPC ..... C10M 2207/028; C10M 2207/262; C10M 2219/046; C10M 2223/045; C10M 2223/047
USPC ..... 508/100, 370, 371, 391
See application file for complete search history.

(56) References Cited

U.S. PATENT DOCUMENTS

2002/0142922 A1 10/2002 Yagishita et al.
2008/0020952 A1* 1/2008 Yagishita ..... 508/186

FOREIGN PATENT DOCUMENTS

| | | | |
|---|---|---|---|
| EP | 1 227 145 | A1 | 7/2002 |
| EP | 1 516 910 | A1 | 3/2005 |
| JP | 01-502988 | A | 10/1989 |
| JP | 08-302378 | A | 11/1996 |
| JP | 2002-294271 | A | 10/2002 |
| WO | 87/07638 | A2 | 12/1987 |
| WO | 02/16533 | A2 | 2/2002 |

OTHER PUBLICATIONS

Kazuhiro Yagishita, et al; "Performance of Engine Oils Formulated with Zinc Dialkylthiophosphate", Published in 2009; Preprints of Meeting on Automotive Engineers, No. 131-09, pp. 11-16 abstract in English.

Kazuhiro Yagishita, et al; "Wear Reducing Performance of Zinc Dialkylthiophosphate", Proceedings of JAST Tribology Conference Nagoya, 2008, pp. 299-300 abstract in English.

Kazuhiro Yagishita, et al; "Lubrication Characteristics of Zinc Dialkylthiophosohate and Surface Analysis of Lubrication Films", The Japan Society for Abrasive Technology Gakujutsu Koenkai Koen Ronbunshu, 2009, pp. 125-126 abstract in English.

International Search Report: mailed May 17, 2011; Appln. No. PCT/JP2011/053966.

Extended European Search Report dated Sep. 12, 2013; Appln. No. 11756037.5-1352/ 2548939 PCT/JP2011053966.

Chinese First Office Action dated May 27, 2013; Appln. No. 201180013577.0.

* cited by examiner

*Primary Examiner* — Vishal Vasisth
(74) *Attorney, Agent, or Firm* — Ladas & Parry LLP

(57) ABSTRACT

The present invention provides a lubricating oil composition comprising: a lubricant base oil; and a dialkyl monothiophosphate metal salt, wherein based on the total mass of the lubricating oil composition, the dialkyl monothiophosphate metal salt is contained in an amount of 0.005 to 0.12 mass % in terms of phosphorus; thereby it is possible to provide the lubricating oil composition which can be reduced in the sulfur content and which exhibits excellent friction reduction while maintaining the anti-wear property equivalent to that of the ZnDTP-added oil.

1 Claim, No Drawings

LUBRICATING OIL COMPOSITION

This application is a 371 of PCT/JP2011/053966, filed Feb. 23, 2011.

TECHNICAL FIELD

The present invention relates to a lubricating oil composition.

BACKGROUND ART

Conventionally, a lubricating oil has been used for an internal combustion engine, automatic transmission, grease and the like in order to operate them smoothly. Among these uses, the lubricating oil for an internal combustion engine (sometimes called an "engine oil") is particularly required to exhibit a high performance due to the high performance, high power, and severe operating conditions of the internal combustion engine.

In order to achieve the above required performance, various additives such as an anti-wear agent, metallic detergent, ashless dispersant and antioxidant are contained in the conventional lubricating oil for an internal combustion engine. Above all, zinc dialkyl dithiophosphate (ZnDTP) is used in the lubricating oil for an internal combustion engine as an essential additive since it can serve as the anti-wear agent and antioxidant (see below Patent Document 1 for example).

CITATION LIST

Patent Literature

Patent Document 1: Japanese Patent Application Laid-Open No. 08-302378

SUMMARY OF INVENTION

Problems to be Solved by the Invention

Further, in order to reduce friction loss and to improve fuel efficiency, organic molybdenum compounds containing metal and sulfur, such as molybdenum dithiocarbamate and molybdenum dithiophosphate, have been generally added to a fuel-saving engine oil. Additionally, in order to produce the friction reduction effect, such an approach has been generally taken in which an adequately large amount of compound containing sulfur and metal such as zinc dialkyl dithiophosphate (ZnDTP) is used together to form a molybdenum disulfide layer on a sliding surface. As such, the conventional fuel-saving engine oil contains a relatively large amount of sulfur, and it has been difficult to lower the sulfur content while maintaining its performance. In order to solve this problem, it is suggested that zinc dialkyl phosphate (ZP) be contained as an alternative to ZnDTP to thereby lower the sulfur content while maintaining excellent friction reduction; however a problem is found in the anti-wear property.

The present invention has been made in view of the problems of the above conventional art; and an object of the present invention is to provide a lubricating oil composition which is capable of maintaining its anti-wear property and also enables sulfur content reduction and excellent friction reduction to be compatible.

Means for Solving the Problems

As a result of intensive studies to achieve the above objective, the inventor discovered that by using a specific dialkyl monothiophosphate metal salt as an alternative to ZnDTP (a first aspect of the present invention), or by using a combination of a specific dialkyl monothiophosphate metal salt and a specific metallic detergent (a second aspect of the present invention), it is possible to lower the sulfur content and to exhibit excellent friction reduction while maintaining the anti-wear property equivalent to that of the ZnDTP-added oil.

First Aspect of the Present Invention

A first aspect of the present invention is a lubricating oil composition comprising: a lubricant base oil; and a dialkyl monothiophosphate metal salt, wherein based on the total mass of the lubricating oil composition, the dialkyl monothiophosphate metal salt is contained in an amount of 0.005 to 0.12 mass % in terms of phosphorus.

In the first aspect of the present invention, the dialkyl monothiophosphate metal salt is preferably a metal salt of a phosphorus compound represented by the below formula (1).

[Chemical Formula 1]

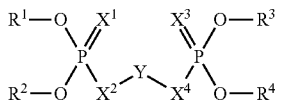

(1)

In the formula (1), $R^1$-$R^4$ each represent a $C_3$-$C_{30}$ linear alkyl group and they may be the same or different from one another; $X^1$-$X^4$ are selected from a sulfur atom and an oxygen atom, three of $X^1$-$X^4$ being oxygen atoms and one of $X^1$-$X^4$ being a sulfur atom; and Y represents a metal atom having two or more valences.

In the first aspect of the present invention, a carbon number of the linear alkyl groups in the metal salt of the phosphorus compound is preferably 6 to 9.

Second Aspect of the Present Invention

A second aspect of the present invention is a lubricating oil composition comprising: a base oil; a metal salt of a phosphorus compound represented by the below formula (10); and a metallic detergent alkylated by a linear α-olefin, wherein based on the total mass of the lubricant oil composition, the metal salt of the phosphorus compound is contained in an amount of 0.005 mass % or more and 0.12 mass % or less in terms of phosphorus.

[Chemical Formula 2]

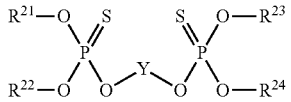

(10)

In the formula (10), $R^{21}$-$R^{24}$ each represent a $C_1$-$C_{30}$ linear alkyl group and they may be the same or different from one another; and Y represents a metal atom having two or more valences.

In the second aspect of the present invention, an average carbon number of the linear alkyl group in the metal salt of the phosphorus compound is preferably 5 to 9.

In the second aspect of the present invention, the linear alkyl group in the metal salt of the phosphorus compound is preferably a combination of $C_1$-$C_6$ linear alkyl group and $C_7$-$C_{20}$ linear alkyl group.

Effects of the Invention

According to the lubricating oil composition of the first aspect of the present invention, the specific dialkyl monothiophosphate metal salt (hereinafter, sometimes referred to as a first metal salt of a phosphorus compound) is contained, thereby enabling decrease in the sulfur content and excellent friction reduction while maintaining the anti-wear property equivalent to that of the ZnDTP-added oil.

According to the lubricating oil compositor of the second aspect of the present invention, the specific dialkyl monothiophosphate metal salt (hereinafter, sometimes referred to as a second metal salt of a phosphorus compound) and the specific metallic detergent are contained in combination, thereby enabling decrease in the sulfur content and excellent friction reduction while maintaining the anti-wear property equivalent to that of the ZnDTP-added oil.

MODES FOR CARRYING OUT THE INVENTION

Hereinafter, preferred modes of the present invention will be described in detail.

<Lubricating Oil Composition of the First Aspect of the Present Invention>

The lubricating oil composition of the first aspect of the present invention comprises a lubricant base oil and a first metal salt of a phosphorus compound.

(Lubricant Base Oil)

The lubricant base oil to be contained in the lubricating oil composition of the present invention is not particularly limited: any lubricant base oils used in ordinary lubricating oils may be employed. Specifically, a mineral lubricant base oil, a synthetic lubricant base oil, a mixture of two or more lubricant base oils selected from these and mixed in an arbitrary ratio, and so on may be used.

Specific examples of the mineral lubricant base oil include: an oil which is obtained by refining a lubricating oil fraction produced by vacuum-distilling a topped crude resulting from atmospheric distillation of a crude oil, through one or more treatments such as solvent deasphalting, solvent extraction, hydrocracking, solvent dewaxing, and hydrorefining; a wax-isomerized mineral oil; and a base oil produced by isomerizing GTL WAX (gas-to-liquid wax).

Specific examples of the synthetic base oil include: polybutene or the hydrogenated product thereof; poly-α-olefins such as 1-octene oligomer and 1-decene oligomer, or the hydrogenated product thereof; diesters such as ditridecyl glutalate, di-2-ethylhexyl adipate, diisodecyl adipate, ditridecyl adipate, and di-2-ethylhexyl sebacate; polyol esters such as trimethylolpropane caprylate, trimethylolpropane pelargonate, pentaerythritol-2-ethyl hexanoate, and pentaerythritol pelargonate; and aromatic synthetic oils such as alkyl naphthalene and alkyl benzene, or the mixture thereof.

The kinematic viscosity of the lubricant base oil is not particularly limited. However, the kinematic viscosity thereof at 100° C. is preferably 50 $mm^2/s$ or less, more preferably 40 $mm^2/s$ or less, still more preferably 20 $mm^2/s$ or less, and especially preferably 10 $mm^2/s$ or less. When the kinematic viscosity of the lubricant base oil at 100° C. exceeds 50 $mm^2/s$, the property of low-temperature viscosity is likely to be poor. In addition, the kinematic viscosity of the lubricant base oil at 100° C. is preferably 1 $mm^2/s$ or more, and more preferably 2 $mm^2/s$ or more. When the kinematic viscosity thereof at 100° C. is less than 1 $mm^2/s$, the lubricity at the area to be lubricated tends to be degraded due to poor oil layer formation thereat, and the amount of evaporation loss of the lubricant base oil tends to increase. Here, the "kinematic viscosity at 100° C." refers to a kinematic viscosity at 100° C. specified by JIS K2283.

Further, the viscosity index of the lubricant base oil is not particularly limited; however, in view of the property of low-temperature viscosity, it is preferably 80 or more. Moreover, in order to attain excellent viscosity characteristics in a wide temperature range of from low temperature to high temperature, the viscosity index of the lubricant base oil is more preferably 100 or more, still more preferably 110 or more, and especially preferably 120 or more.

Furthermore, the sulfur content of the lubricant base oil is not particularly limited; however, it is preferably 0.1 mass % or less, and more preferably 0.01 mass % or less, still more preferably 0.005 mass % or less, and it is in especial preferably substantially sulfur-free (e.g. 0.001 mass % or less). It should be noted that the term "sulfur content" in the present invention means a value measured in accordance with JIS K2541-4 "Energy-dispersive X-ray fluorescence method" (in general, a range of 0.01 to 5 mass %) or JIS K2541-5 "Bomb mass determination method, Annex (Regulations), Inductively coupled plasma emission method" (in general, 0.05 mass % or more).

The total aromatic content of the lubricant base oil is not particularly limited; however, it is preferably 30 mass % or less; more preferably 15 mass % or less; still more preferably 5 mass % or less; and especially preferably 2 mass % or less. When the total aromatic content of the lubricant base oil exceeds 30 mass %, the oxidation stability is likely to be poor. It should be noted that the "total aromatic content" in the present invention means an aromatic fraction content measured in accordance with ASTM D2549. Usually, the aromatic fraction not only includes alkyl benzene and alkyl naphthalene, but also includes anthracene, phenanthrene, and the alkylated product thereof; compounds in which four or more benzene rings are condensed; and compounds having heteroaromatics such as pyridines, quinolines, phenols, and naphthols.

(Dialkyl Monothiophosphate Metal Salt (a First Metal Salt of a Phosphorus Compound)

The lubricating oil composition of the first aspect of the present invention comprises the first metal salt of the phosphorus compound represented by the below formula (1), in addition to the above described lubricant base oil.

[Chemical Formula 3]

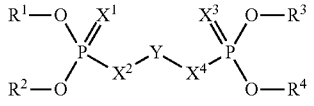

(1)

In the formula (1), $R^1$-$R^4$ each represent a $C_3$-$C_{30}$ linear alkyl group and they may be the same or different from one another; $X^1$-$X^4$ are selected from a sulfur atom and an oxygen atom, three of $X^1$-$X^4$ being oxygen atoms and one of $X^1$-$X^4$ being a sulfur atom; and Y represents a metal atom having two or more valences.

In the formula (1), examples of the $C_3$-$C_{30}$ linear alkyl group represented by $R^1$-$R^4$ include: n-propyl, n-butyl, n-pentyl, n-hexyl, n-heptyl, n-octyl, n-nonyl, n-decyl, n-undecyl, n-dodecyl, n-tridecyl, n-tetradecyl, n-pentadecyl, n-hexadecyl, n-heptadecyl, and n-octadecyl.

$R^1$-$R^4$ are each preferably a $C_4$-$C_{14}$ linear alkyl group, more preferably a $C_5$-$C_{12}$ linear alkyl group, and still more preferably a $C_6$-$C_9$ linear alkyl group.

$X^1$-$X^4$ are selected from a sulfur atom and an oxygen atom; as long as one of $X^1$-$X^4$ is a sulfur atom and the other three are oxygen atoms, any one of $X^1$-$X^4$ may be a sulfur atom.

Specific examples of the metal of the above metal salt include: alkaline earth metals such as calcium, magnesium, and barium; and heavy metals such as zinc, copper, iron, lead, nickel, silver, manganese, and molybdenum. Among these, the alkaline earth metals such as calcium and magnesium, molybdenum, and lead are preferable; and lead is especially preferable.

In the first aspect of the present invention, the first metal salt of the phosphorus compound represented by the above formula (1) may be used alone; or two or more may be used in combination.

In the lubricating oil composition of the first aspect of the present invention, the content of the first metal salt of the phosphorus compound represented by the formula (1), to the total mass of the lubricating oil composition, needs to be 0.005 mass % or more and 0.12 mass % or less in terms of phosphorus; and is preferably 0.01 mass % or more and 0.115 mass % or less, more preferably 0.03 mass % or more and 0.11 mass % or less, and still more preferably 0.05 mass % or more and 0.105 mass % or less. Here, if the content of the first metal salt of the phosphorus compound represented by the formula (1) is less than the above mentioned lower limit, the wear resistance property becomes insufficient; and if it exceeds the above mentioned upper limit, poisoning of an exhaust gas purifying catalyst tends to be brought about. Thus, both cases are unfavorable.

(Various Kinds of Additives)

The lubricating oil composition of the first aspect of the present invention may comprise various kinds of additives described below, in addition to the lubricant base oil and the first metal salt of the phosphorus compound represented by the below formula (1).

(Other Metal Salts of Phosphorus Compounds)

The lubricating oil composition in the first aspect of the present invention may comprise metal salts of phosphorus compounds represented by the formulas (2) and (3), other than the first metal salt of the phosphorus compound represented by the formula (1).

[Chemical Formula 4]

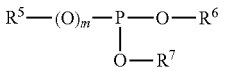

(2)

In the above formula (2), $R^5$ represents a $C_1$-$C_{30}$ alkyl group; $R^6$ and $R^7$ may be the same or different from each other, each representing a hydrogen atom or a $C_1$-$C_{30}$ alkyl group; and m represents 0 or 1.

[Chemical Formula 5]

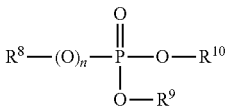

(3)

In the formula (3), $R^8$ represents a $C_1$-$C_{30}$ alkyl group; $R^9$ and $R^{10}$ may be the same or different from each other, each representing a hydrogen atom or a $C_1$-$C_{30}$ alkyl group; and n represents 0 or 1.

In the above formulas (2) and (3), $R^5$-$R^{10}$ are each preferably a $C_1$-$C_{30}$ alkyl group, more preferably a $C_3$-$C_{18}$ alkyl group, and still more preferably a $C_4$-$C_{12}$ alkyl group. Examples of the alkyl group include: methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl (these alkyl groups may be linear or branched).

Specific examples of the metal of the above metal salt include: alkali metals such as lithium, sodium, potassium, and cesium; alkaline earth metals such as calcium, magnesium, and barium; and heavy metals such as zinc, copper, iron, lead, nickel, silver, manganese, and molybdenum. Among these, the alkaline earth metals such as calcium and magnesium, molybdenum, and lead are preferable; and lead is especially preferable.

The metal salts of the phosphorus compounds represented by the above formulas (2) and (3) have different structures depending on the metal valence and/or the number of hydroxyl group of the phosphorus compounds; thus the structures of the metal salts of the phosphorus compounds represented by the formulas (2) and (3) are not particularly limited. For example, when one mole of zinc oxide and two moles of phosphate diester (a compound having one hydroxyl group) are reacted to each other, a compound having a structure represented by the below formula (4) is thought to be obtained as a main component, and at the same time polymerized molecules are also thought to be present.

[Chemical Formula 6]

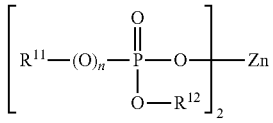

(4)

In the above formula (4), $R^{11}$ and $R^{12}$ each represent a $C_1$-$C_{30}$ alkyl group; and n is 0 or 1.

Further, when one mole of zinc oxide and one mole of phosphate monoester (a compound having two hydroxyl groups) are reacted to each other for example, a compound having a structure represented by the below formula (5) is thought to be obtained as a main component, and at the same time polymerized molecules are also thought to be present.

[Chemical Formula 7]

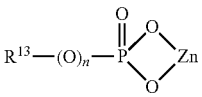

(5)

In the above formula (5), $R^{13}$ is a $C_1$-$C_{30}$ alkyl group; and n is 0 or 1.

In the present invention, the metal salt of the phosphorus compound represented by the above formula (2) or (3) may be used alone; or two or more may be used in combination.

The content of the metal salt of the phosphorus compound represented by the formula (2) or (3) is preferably 0.05 mass % or less, more preferably 0.04 mass % or less, and still more preferably 0.03 mass % or less in terms of phosphorus, based on the total mass of the composition.

The total phosphorus concentration in the lubricating oil composition of the first aspect of the present invention is preferably 0.005 mass % or more and 0.12 mass % or less, more preferably 0.03 mass % or more and 0.11 mass % or less, and further more preferably 0.05 mass % or more and 0.105 mass % or less in terms of phosphorus, based on the total mass of the lubricating oil composition. If the phosphorus concentration in the lubricating oil composition exceeds the above upper limit, poisoning of an exhaust gas purifying catalyst tends to be brought about.

(Metallic Detergent)

The lubricating oil composition of the first aspect of the present invention preferably further comprises a metallic detergent in order to further improve its acid neutralization property, high-temperature detergency, and anti-wear property.

Examples of the metallic detergent include: alkali metal sulfonate or alkaline earth metal sulfonate; alkali metal phenate or alkaline earth metal phenate; alkali metal salicylate or alkaline earth metal salicylate; alkali metal phosphonate or alkaline earth metal phosphonate; and the mixture thereof.

Preferred examples of the alkali metal or alkaline earth metal sulfonate are alkali metal salts or alkaline earth metal salts of alkyl aromatic sulfonic acids, in particular a magnesium salt and/or calcium salt, obtained by sulfonating alkyl aromatic compounds having a molecular weight of 100 to 1500, preferably of 200 to 700. Specific examples of the alkyl aromatic sulfonic acid include the so-called petroleum sulfonate and synthetic sulfonate.

As the petroleum sulfonate, the following may be generally used for example: those obtained by sulfonating alkyl aromatic compounds in the lubricating oil fraction of a mineral oil; and the so-called mahogany acid obtained as a by-product in the manufacturing of white oil.

Further, as the synthetic sulfonate, the following may be used for example: those obtained by sulfonating alkylbenzene having a linear or branched alkyl group, which is produced as a by-product from a manufacturing plant of alkylbenzene used as a source material of detergents, or which results from alkylation of benzene with polyolefin; and those obtained by sulfonating dinonylnaphthalene. In addition, a sulfonating agent to sulfonate these alkyl aromatic compounds is not particularly limited; in general, fuming sulfuric acid and sulfuric acid are used.

As the alkali metal or alkaline earth metal phenate, the following is preferably used in specific: an alkali metal salt or an alkaline earth metal salt, in particular, a magnesium salt and/or calcium salt etc. of: alkylphenol having at least one $C_{4-30}$, preferably $C_{6-18}$ linear or branched alkyl group; alkylphenol sulfide obtained by reacting such alkylphenol with sulfur; or the Mannich reaction product of alkylphenol obtained by reacting such alkylphenol with formaldehyde.

As the alkali metal salicylate or alkaline earth metal salicylate, the following is preferably used in specific: an alkali metal salt or an alkaline earth metal salt, in particular, a magnesium salt and/or calcium salt etc. of alkylsalicylic acid having at least one $C_{4-30}$, preferably $C_{6-18}$ linear or branched alkyl group.

Furthermore, the alkali metal or alkaline earth metal sulfonate, the alkali metal or alkaline earth metal phenate, and the alkali metal or alkaline earth metal salicylate not only include a neutral salt (normal salt) which is obtained for example by reacting an alkyl aromatic sulfonic acid, alkylphenol, alkylphenol sulfide, the Mannich reaction product of alkylphenol, alkylsalicylic acid etc. directly with a metallic base such as an oxide and hydroxide of an alkali metal or alkaline earth metal, or by once making an alkali metal salt such as a sodium salt and potassium salt and then substituting it with an alkaline earth metal salt; but also include a basic salt obtained by heating the neutral salt (normal salt) and an excessive amount of alkali metal salt or alkaline earth metal salt or alkali metal base or alkaline earth metal base (a hydroxide or oxide of an alkali metal or alkaline earth metal) in the presence of water; and an overbased salt (ultrabasic salt) obtained by reacting the neutral salt (normal salt) with a base such as a hydroxide of an alkali metal or alkaline earth metal in the presence of carbondioxide and/or boric acid or borate.

The metallic detergent is usually made commercially available in a form of being diluted with a light lubricant base oil and the like. In general, it is desirable to use a metallic detergent with a metal content of 1.0 to 20 mass %, preferably 2.0 to 16 mass %. Further, the base number of the metallic detergent is usually 0 to 500 mgKOH/g, preferably 20 to 450 mgKOH/g. Here, the term "base number" means a base number measured by the perchloric acid method in accordance with No. 7 in JIS K2501 "Petroleum products and lubricating oils-Determination of neutralization number".

In the present invention, one selected from the alkali metal or alkaline earth metal sulfonate, the alkali metal or alkaline earth metal phenate, the alkali metal or alkaline earth metal salicylate etc. may be used alone or two or more selected from these may be used in combination.

As for the metallic detergent, the alkali metal or alkaline earth metal salicylate is particularly preferable in that it has increased friction reduction effect enabled by ash reduction and that it excels in a long-drain performance.

The metal ratio of the metallic detergent is not particularly limited; and a metallic detergent with a metal ratio of 20 or less may be usually used. However, in view of capability of improving the friction reduction effect and the long-drain performance, it is desirable to employ one or more selected from the metallic detergents having a metal ratio of preferably 1 to 10. Here, the "metal ratio" is represented by "a valence of metal element×a content of metal element (mol %)/a content of soap group (mol %)" in a metallic detergent, wherein the metal element refers to calcium, magnesium, or the like, and the soap group refers to a sulfonic acid group, salicylic acid group, or the like.

The upper limit of the content of the metallic detergent in the lubricating oil composition of the first aspect of the present invention is not particularly limited; and based on the total mass of the lubricating oil composition, it is usually 0.5 mass % or less in terms of metal element. However, it is preferable to adjust the content of the metallic detergent with other additives so that the sulfuric acid ash content in the composition becomes 1.0 mass % or less, based on the total mass of the composition. In such a viewpoint, the content of the metallic detergent, to the total mass of the composition, is preferably 0.3 mass % or less, and more preferably 0.23 mass % or less in terms of metal element. Further, the content of the metallic detergent is preferably 0.01 mass % or more, more preferably 0.02 mass % or more, and still more preferably 0.15 mass % or more. When the content of the metallic detergent is less than 0.01 mass %, it is difficult to ensure the high-temperature detergency, oxidation stability, and the long-drain performance such as base number retention, which is thus unfavorable.

(Ashless Dispersant)

The lubricating oil composition of the first aspect of the present invention preferably further comprises an ashless dispersant. As the ashless dispersant, any ashless dispersants used for a lubricating oil may be used. Examples thereof include: nitrogen-containing compounds having at least one $C_{40}$-$C_{400}$ linear or branched alkyl group or alkenyl group in the molecule, or derivatives thereof; and modified products of alkenyl succinimide. One or more randomly selected from these may be contained.

The carbon number of the alkyl group or the alkenyl group is 40 to 400, preferably 60 to 350. When the carbon number of the alkyl group or the alkenyl group is less than 40, solubility of the compound in the lubricant base oil tends to degrade. On the other hand, when the carbon number of the alkyl group or the alkenyl group exceeds 400, the low-temperature fluidity of the lubricating oil composition tends to be deteriorated. Thus, both cases are unfavorable. The alkyl group or the alkenyl group may be linear or branched. Specifically, preferred examples thereof include: a branched alkyl group or branched alkenyl group derived from an oligomer of olefin such as propylene, 1-butene, and isobutene, or from a co-oligomer of ethylene and propylene.

Specific examples of the ashless dispersant are the following compounds. One or more compounds selected from these may be used.

(I) succinimide having at least one $C_{40}$-$C_{400}$ alkyl group or alkenyl group in the molecule, or derivatives thereof;

(II) benzylamine having at least one $C_{40}$-$C_{400}$ alkyl group or alkenyl group in the molecule, or derivatives thereof; and (III) polyamine having at least one $C_{40}$-$C_{400}$ alkyl group or alkenyl group in the molecule, or derivatives thereof.

Specific examples of the above (I) succinimide include compounds represented by the below formulas (6) and (7).

[Chemical Formula 8]

(6)

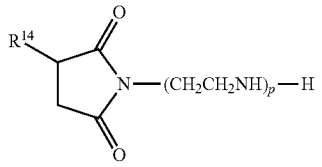

In the above formula (6), $R^{14}$ represents a $C_{40}$-$C_{400}$, preferably $C_{60}$-$C_{350}$ alkyl group or alkenyl group; and p represents an integer of 1 to 5, preferably of 2 to 4.

[Chemical Formula 9]

(7)

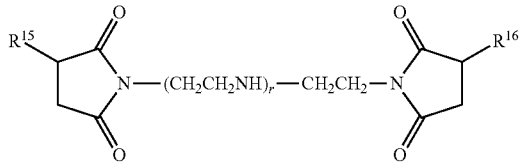

In the above formula (7), $R^{15}$ and $R^{16}$ independently represent a $C_{40}$-$C_{400}$, preferably $C_{60}$-$C_{350}$ alkyl group or alkenyl group, and in particular preferably represent a polybutenyl group; and r represents an integer of 0 to 4, preferably of 1 to 3.

The (I) succinimide includes: a so-called mono-type succinimide represented by the formula (6) wherein succinic anhydride is added to one end of polyamine; and a so-called bis-type succinimide represented by the formula (7) wherein succinic anhydride is added to both ends of polyamine. The lubricating oil composition of the first aspect of the present invention may contain one of these or a mixture thereof.

A production method of the above (I) succinimide is not particularly limited; and the succinimide can be produced for example by bringing a compound having a $C_{40}$-$C_{400}$ alkyl group or alkenyl group into reaction with maleic anhydride at a temperature of 100 to 200° C. to obtain alkyl or alkenyl succinic acid, which is then reacted with polyamine. Specific examples of the polyamine include: diethylenetriamine; triethylenetetramine; tetraethylenepentamine; and pentaethylenehexamine.

Specific examples of the above (II) benzylamine include a compound represented by the below formula (8).

[Chemical Formula 10]

(8)

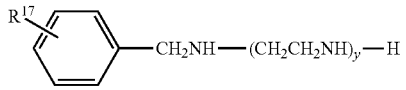

In the above formula (8), $R^{17}$ represents a $C_{40}$-$C_{400}$, preferably $C_{60}$-$C_{350}$ alkyl group or alkenyl group; and y represents an integer of 1 to 5, preferably of 2 to 4.

Specific examples of the above (III) polyamine include a compound represented by the below formula (9).

$$R^{18}—NH—(CH_2CH_2NH)_z—H \quad (9)$$

In the above formula (9), $R^{18}$ represents a $C_{40}$-$C_{400}$, preferably $C_{60}$-$C_{350}$ alkyl group or alkenyl group; and z represents an integer of 1 to 5, preferably of 2 to 4.

Further, the derivatives of the nitrogen-containing compound given as an example of the ashless dispersant include: a so-called acid-modified compound obtained by bringing the above mentioned nitrogen-containing compound into reaction with a $C_1$-$C_{30}$ monocarboxylic acid (e.g. fatty acid) or with a $C_2$-$C_{30}$ polycarboxylic acid such as oxalic acid, phthalic acid, trimellitic acid, and pyromellitic acid so as to neutralize or amidine the part or whole of the remaining amino group and/or imino group; a so-called boron-modified compound obtained by bringing the above nitrogen-containing compound into reaction with boric acid to neutralize or amidize the part or whole of the remaining amino group and/or imino group; a so-called sulfur-modified compound obtained by bringing the above nitrogen-containing compound into reaction with a sulfur compound; and a modified compound obtained by combining the above nitrogen-containing compound with two or more modifications selected from the acid modification, boron modification, and sulfur modification. Among these derivatives, the boron-modified compound of alkenyl succinimide excels in the heat resistance property and antioxidant property; and thus is effective for the lubricating oil composition of the first aspect of the present invention in order to improve the base number retention and high-temperature detergency.

When the ashless dispersant is contained in the lubricating oil composition of the first aspect of the present invention, the content thereof to the total mass of the lubricating oil composition is usually 0.01 mass % or more and 20 mass % or less, and preferably 0.1 mass % or more and 10 mass % or less. When the content of the ashless dispersant is less than 0.01 mass %, the effects on the base number retention under high temperatures degrade. On the other hand, when the content thereof exceeds 20 mass %, the low-temperature fluidity of the lubricating oil composition is greatly deteriorated. Thus, both cases are unfavorable.

(Chain-Terminating Antioxidant)

The lubricating oil composition of the first aspect of the present invention preferably further comprises a chain-terminating antioxidant. This helps to improve the antioxidant property of the lubricating oil composition, thus enabling improvement of the base number retention and high-temperature detergency in the present invention.

As the chain-terminating antioxidant, those generally used for a lubricating oil, such as a phenol-based antioxidant, amine-based antioxidant, and metallic antioxidant, may be used.

Preferred examples of the phenol-based antioxidant include: 4,4'-methylenebis(2,6-di-tert-butylphenol); 4,4'-bis(2,6-di-tert-butylphenol); 4,4'-bis(2-methyl-6-tert-butylphenol); 2,2'-methylenebis(4-ethyl-6-tert-butylphenol); 2,2'-methylenebis(4-methyl-6-tert-butylphenol); 4,4'-butylidenebis(3-methyl-6-tert-butylphenol); 4,4'-isopropylidenebis(2,6-di-tert-butylphenol); 2,2'-methylenebis(4-methyl-6-nonylphenol); 2,2'-isobutylidenebis(4,6-dimethylphenol); 2,2'-methylenebis(4-methyl-6-cyclohexylphenol); 2,6-di-tert-butyl-4-methylphenol; 2,6-di-tert-butyl-4-ethylphenol; 2,4-dimethyl-6-tert-butylphenol; 2,6-di-tert-α-dimethylamino-p-cresol; 2,6-di-tert-butyl-4(N,N'-dimethylaminomethylphenol); 4,4'-thiobis(2-methyl-6-tert-butylphenol); 4,4'-thiobis(3-methyl-6-tert-butylphenol); 2,2'-thiobis(4-methyl-6-tert-butylphenol); bis(3-methyl-4-hydroxy-5-tert-butylbenzyl)sulfide; bis(3,5-di-tert-butyl-4-hydroxybenzyl) sulfide; 2,2'-thio-diethylenebis[3-(3,5-di-tert-butyl-4-hydroxyphenyl)propionate]; tridecyl-3-(3,5-di-tert-butyl-4-hydroxyphenyl)propionate; pentaerythrityl-tetraquis[3-(3,5-di-tert-butyl-4-hydroxyphenyl)propionate; octyl-3-(3,5-di-tert-butyl-4-hydroxyphenyl)propionate; octadecyl-3-(3,5-di-tert-butyl-4-hydroxyphenyl)propionate; 3-methyl-5-tert-butyl-4-hydroxyphenyl substituted fatty acid esters. These may be used alone or a mixture of two or more of these may be used.

Examples of the amine-based antioxidant include: phenyl-α-naphthyl amine; alkylphenyl-α-naphthyl amine; and dialkyl diphenyl amine. These may be used alone or a mixture of two or more of these may be used.

Further, the above phenol-based antioxidant and amine-based antioxidant may be used in combination.

When the chain-terminating antioxidant is contained in the lubricating oil composition of the first aspect of the present invention, the content thereof to the total mass of the lubricating oil composition is usually 5.0 mass % or less, preferably 3.0 mass % or less, and more preferably 2.5 mass % or less. If the content of the chain-terminating antioxidant exceeds 5.0 mass %, a satisfactory antioxidant property proportional to the content cannot be ensured, which is thus unfavorable. On the other hand, in order to further improve the base number retention and high-temperature detergency during the course of lubricating oil degradation, the content thereof to the total mass of the lubricating oil composition is preferably 0.1 mass % or more, and more preferably 1 mass % or more.

(Conventional Additives)

The lubricating oil composition of the first aspect of the present invention may contain any kind of additives generally used for a lubricating oil depending on the purposes, in order to further enhance its performance. Examples of such additives include: an anti-wear agent, friction modifier, viscosity index improver, corrosion inhibitor, rust inhibitor, demulsifier, metal deactivator, defoamant, and coloring agent.

Examples of the anti-wear agent include sulfur-containing compounds such as disulfide; sulfurized olefin; sulfurized fat and oil; dithiophosphate metal salt (zinc salt, molybdenum salt etc.); dithiocarbamate metal salt (zinc salt, molybdenum salt etc.); dithiophosphate ester and the derivatives thereof (reaction products with olefin cyclopentadiene, (methyl) methacrylic acid, propionic acid and the like; in the case of propionic acid, those added to the beta position are preferred); trithiophosphate ester; and dithiocarbamate ester. Usually, these may be contained in a range of 0.005 mass % or more and 5 mass % or less based on the total mass of the composition as long as the performance of the composition of the present invention is not deteriorated drastically. However, in view of the minimization of sulfur content and long-drain performance, the content thereof to the total mass of the composition is preferably 0.1 mass % or less, and more preferably 0.05 mass % or less in terms of sulfur.

As the friction modifier, any compounds generally used as a friction modifier for a lubricating oil may be used. Examples thereof include: molybdenum-based friction modifiers such as molybdenum disulfide, molybdenum dithiocarbamate, and molybdenum dithiophosphate; and ashless friction modifiers having in the molecule at least one $C_6$-$C_{30}$ alkyl or alkenyl group, particularly linear $C_6$-$C_{30}$ alkyl or alkenyl group, such as amine compounds, fatty acid ester, fatty acid amide, fatty acid, aliphatic alcohol, aliphatic ether, hydrazide (oleyl hydrazide etc.), semicarbazide, urea, ureido, and biuret. The content of these friction modifiers to the total mass of the composition is usually 0.1 mass % or more and 5 mass % or less.

Specific examples of the viscosity index improver include: a so-called non-dispersant viscosity index improver such as a polymer of one kind of monomer or a copolymer of two or more kinds of monomers selected from various methacrylic acid esters, or the hydrogenated product thereof; a so-called dispersant viscosity index improver obtained by copolymerizing various methacrylic acid esters containing nitrogen compounds; a non-dispersant or dispersant ethylene-α-olefin copolymer (examples of α-olefin including propylene, 1-butene, and 1-penten), or the hydrogenated product thereof; polyisobutylene or the hydrogenated product thereof; the hydrogenated product of a styrene-diene copolymer; a styrene-maleic anhydride ester copolymer; and polyalkylstyrene.

The molecular weight of these viscosity index improvers needs to be selected in consideration of the shear stability. Specifically, in the case of dispersant and non-dispersant polymethacrylate for example, the number average molecular weight of the viscosity index improver is usually 5,000 to 1,000,000, preferably 100,000 to 900,000; in the case of polyisobutylene or the hydrogenated product thereof, the number average molecular weight of the viscosity index improver is usually 800 to 5,000, preferably 1,000 to 4,000; and in the case of an ethylene-α-olefin copolymer or the hydrogenated product thereof, the number average molecular weight of the viscosity index improver is usually 800 to 500,000, preferably 3,000 to 200,000.

Further, when the ethylene-α-olefin copolymer or the hydrogenated product thereof is used among these viscosity index improvers, it is possible to obtain a lubricating oil composition with a particularly excellent shear stability. One or more compounds randomly selected from the above viscosity index improvers may be contained in an adequate amount. The content of the viscosity index improver to the total mass of the composition is usually 0.1 mass % or more and 20 mass % or less.

Examples of the corrosion inhibitor include benzotriazole-based, tolyltriazole-based, thiadiazole-based, and imidazole-based compounds.

Examples of the rust inhibitor include: petroleum sulfonate, alkyl benzene sulfonate, dinonylnaphthalene sulfonate, alkenyl succinic acid ester, and polyvalent alcohol ester.

Examples of the demulsifier include: polyalkylene glycol-type nonionic surfactants such as polyoxyethylene alkylether, polyoxyethylene alkylphenylether, and polyoxyethylene alkylnaphthylether.

Examples of the metal deactivator include: imidazoline, pyrimidine derivatives, alkylthiadiazole, mercapto benzothiazole, benzotriazole or derivatives thereof, 1,3,4-thiadiazole polysulfide, 1,3,4-thiadiazolyl-2,5-bisdialkyl dithiocarbamate, 2-(alkyldithio)benzimidazole, and β-(o-carboxybenzylthio)propionitrile.

Examples of the defoamant include: silicone, fluorosilicone, and fluoroalkylether.

When adding these additives to the lubricating oil composition of the first aspect of the invention, the content of each of the corrosion inhibitor, the rust inhibitor, and the demulsifier, to the total mass of the composition, is usually 0.005 mass % or more and 5 mass % or less; the content of the metal deactivator, to the total mass of the composition, is usually 0.005 mass % or more and 1 mass % or less; and the content of the defoamant, to the total mass of the composition, is usually 0.0005 mass % or more and 1 mass % or less.

(Kinematic Viscosity of the Lubricating Oil Composition of the First Aspect of the Present Invention)

The kinematic viscosity at 100° C. of the lubricating oil composition of the first aspect of the present invention is 4.1 $mm^2/s$ or more and 21.9 $mm^2/s$ or less, preferably 5.6 $mm^2/s$ or more and 16.3 $mm^2/s$ or less, and still more preferably 5.6 $mm^2/s$ or more and 12.5 $mm^2/s$ or less.

(Sulfur Content of the Lubricating Oil Composition of the First Aspect of the Present Invention)

The sulfur content of the lubricating oil composition of the first aspect of the present invention, to the total mass of the lubricating oil composition, is preferably 0.3 mass % or less, more preferably 0.2 mass % or less, and still more preferably 0.1 mass % or less. By setting the sulfur content at the above upper limit or less, it is possible to realize a low-sulfur lubricating oil composition with an excellent long-drain performance.

(Uses of the Lubricating Oil Composition of the First Aspect of the Present Invention)

The lubricating oil composition of the first aspect of the present invention is capable of maintaining its anti-wear property and also enables sulfur content reduction and excellent friction reduction to be compatible. As such, it can be favorably used as a lubricating oil composition for internal combustion engines such as gasoline engine, diesel engine, and gas engine for motorcycles, automobiles, power generation, and ships. Furthermore, it can also be suitably used as a lubricating oil required to exhibit an anti-wear performance and long-drain performance, for example as a lubricant oil for drive systems such as automatic and manual transmissions, and a lubricating oil such as wet brake oil, hydraulic oil, turbine oil, compressor oil, bearing oil, and refrigerator oil.

<Lubricating Oil Composition of the Second Aspect of the Present Invention>

The lubricating oil composition of the second aspect of the present invention comprises: a lubricant base oil; a second metal salt of a phosphorus compound; and a specific metallic detergent.

(Lubricant Base Oil)

The same lubricant base oils as described in the first aspect of the present invention may be used.

((A) Dialkyl Monothiophosphate Metal Salt (a Second Metal Salt of a Phosphorus Compound)

The lubricating oil composition of the second aspect of the present invention comprises a second metal salt of a phosphorus compound represented by the below formula (10), in addition to the above lubricant base oil.

[Chemical Formula 11]

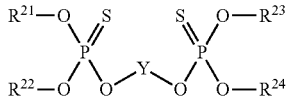

(10)

In the above formula (10), $R^{21}$-$R^{24}$ represent a $C_1$-$C_{30}$ linear alkyl group and they may be the same or different from one another; and Y represents a metal atom having two or more valences.)

In the above formula (10), examples of the $C_1$-$C_{30}$ linear alkyl group represented by $R^{21}$-$R^{24}$ include: methyl; ethyl; n-propyl; n-butyl, n-pentyl, n-hexyl, n-heptyl, n-octyl, n-nonyl, n-decyl, n-undecyl, n-dodecyl, n-tridecyl, n-tetradecyl, n-pentadecyl, n-hexadecyl, n-heptadecyl, and n-octadecyl.

$R^{21}$-$R^{24}$ are each preferably a $C_3$-$C_{14}$ linear alkyl group, and more preferably a $C_4$-$C_{12}$ linear alkyl group.

As to the carbon numbers of $R^{21}$-$R^{24}$, they may be one certain carbon number, or two or more different carbon numbers may be employed in combination. When two or more different carbon numbers are employed in combination, the average carbon number of these $R^{21}$-$R^{29}$ is preferably 5 to 9. In particular, it is preferable to make $R^{21}$-$R^{24}$ be a combination of $C_1$-$C_6$ alkyl and $C_7$-$C_{20}$ alkyl to use a metal salt of a phosphorus compound wherein the average carbon number of the alkyl groups is 5 to 9. Herein, phosphorus compounds having alkyl groups of different carbon numbers may be combined (for example, a phosphorus compound having $R^{21}$-$R^{24}$ with a carbon number of 5 may be combined with a phosphorus with compound having $R^{21}$-$R^{24}$ with a carbon number of 10) to obtain a mixture of the phosphorus compounds wherein the whole average carbon number of the alkyl groups is 5 to 9. Also, a phosphorus compound wherein the molecule has alkyl groups with different carbon numbers may be used, or a mixture thereof may be used. In any case, it is preferable for the phosphorus compound to have two types of alkyl groups, which are a $C_1$-$C_6$ alkyl group and a $C_7$-$C_{20}$ alkyl group so that a whole average carbon number of the alkyl groups becomes 5 to 9.

Specific examples of metal of the above metal salt include: alkaline earth metals such as calcium, magnesium, and barium; and heavy metals such as zinc, copper, iron, lead, nickel, silver, manganese, and molybdenum. Among these, the alkaline earth metals such as calcium and magnesium, molybdenum, and lead are preferable; and lead is especially preferable.

In the lubricating oil composition of the present invention, the content of the metal salt of the phosphorus compound represented by the formula (10) needs to be 0.005 mass % or more and 0.12 mass % or less in terms of phosphorus, based on the total mass of the lubricating oil composition; and is preferably 0.01 mass % or more and 0.11 mass % or less, more preferably 0.03 mass % or more and 0.10 mass % or less, and still more preferably 0.05 mass % or more and 0.09 mass % or less. Here, if the content of the first metal salt of the phosphorus compound represented by the formula (10) is less than the lower limit, the wear resistance property becomes insufficient; and if it exceeds the upper limit, poisoning of an exhaust gas purifying catalyst tends to be brought about. Thus, both cases are unfavorable.

((B) Metallic Detergent Alkylated by a Linear α-Olefin)

The lubricating oil composition of the second aspect of the present invention comprises (B) a metallic detergent alkylated by a linear α-olefin, in addition to the above described lubricant base oil and the second metal salt of the phosphorus compound, in order to improve its acid neutralization property, high-temperature detergency, and anti-wear property.

The metallic detergent is not particularly limited. Examples thereof include: alkali metal sulfonate or alkaline earth metal sulfonate; alkali metal phenate or alkaline earth metal phenate; alkali metal salicylate or alkaline earth metal salicylate; alkali metal phosphonate or alkaline earth metal phosphonate; and the mixture thereof.

Regardless of the types of the metallic detergent, the lipophilic group thereof needs to be alkylated by a linear α-olefin. The carbon number of the linear α-olefin to be used is preferably 4 to 30, more preferably 6 to 28, still more preferably 8 to 26, and most preferably 10 to 24. When the carbon number is less than 4, the oil solubility is likely to be poor; and when the carbon number exceeds 30, the solubility in the base oil and the low-temperature viscosity are likely to be deteriorated.

An example of the alkali metal or alkaline earth metal sulfonate is a metal salt produced by alkylating benzene with the above linear α-olefin to obtain alkylbenzene, sulfonating it with a sulfonating agent such as fuming sulfuric acid and sulfuric acid to obtain alkylbenzene sulfonic acid, and thereafter neutralizing it.

An example of the alkali metal or alkaline earth metal salicylate is a metal salt produced by alkylating phenol or cresol with the above linear α-olefin to obtain alkylphenol, obtaining alkyl salicylic acid through the Koch reaction, and thereafter neutralizing it.

An example of the alkali metal or alkaline earth metal phenate is a metal salt produced by alkylating phenol with the above linear α-olefin to obtain alkylphenol, obtaining alkylphenol sulfide resulting from the reaction of this alkylphenol with sulfur or obtaining the Mannich reaction product of alkylphenol resulting from the reaction of this alkylphenol with formaldehyde, and thereafter neutralizing it.

As the alkali metal or alkaline earth metal, magnesium and/or calcium etc. are, in particular, preferably used.

Furthermore, the alkali metal or alkaline earth metal sulfonate, the alkali metal or alkaline earth metal salicylate, and the alkali metal or alkaline earth metal phenate not only include a neutral salt (normal salt) which is obtained for example by reacting an alkyl aromatic sulfonic acid, alkylsalicylic acid, alkylphenol, alkylphenol sulfide, the Mannich reaction product of alkylphenol etc. directly with a metallic base such as an oxide and hydroxide of an alkali metal or alkaline earth metal, or by once making an alkali metal salt such as a sodium salt and potassium salt and then substituting it with an alkaline earth metal salt; but also include a basic salt obtained by heating the neutral salt (normal salt) and an excessive amount of alkali metal salt or alkaline earth metal salt or alkali metal base or alkaline earth metal base (a hydroxide or oxide of an alkali metal or alkaline earth metal) in the presence of water; and an overbased salt (ultrabasic salt) obtained by reacting the neutral salt (normal salt) with a base such as a hydroxide of an alkali metal or alkaline earth metal in the presence of carbon dioxide and/or boric acid or borate.

The metallic detergent is usually made commercially available in a form of being diluted with a light lubricant base oil and the like. In general, a metal content thereof is preferably 1.0 to 20 mass %, and more preferably 2.0 to 16 mass %. Further, the base number of the metallic detergent is preferably 0 mgKOH/g or more and 500 mgKOH/g or less, more preferably 20 mgKOH/g or more and 450 mgKOH/g or less. Here, the term "base number" means a base number measured by the perchloric acid method in accordance with No. 7 in JIS K2501 "Petroleum products and lubricating oils-Determination of neutralization number".

In the second aspect of the present invention, one selected from the alkali metal or alkaline earth metal sulfonate, the alkali metal or alkaline earth metal salicylate, the alkali metal or alkaline earth metal phenate etc. may be used alone or two or more selected from these may be used in combination. As for the metallic detergent, the alkali metal or alkaline earth metal salicylate is particularly preferable in that it has increased friction reduction effect enabled by ash reduction and it excels in the long-drain performance.

The metal ratio of the metallic detergent is not particularly limited; and a metallic detergent with a metal ratio of 20 or less may be usually used. However, in view of capability of improving the friction reduction effect and the long-drain performance, it is preferable to employ one or more selected from the metallic detergents having a metal ratio of 1 to 10. Here, the "metal ratio" is represented by "a valence of metal element valence×a content of metal element (mol %)/a content of soap group (mol %)" in a metallic detergent wherein the metal element refers to calcium, magnesium or the like; and the soap group refers to a sulfonic acid group, salicylic acid group or the like.

The upper limit of the content of the metallic detergent in the lubricating oil composition of the second aspect of the present invention is not particularly limited; and based on the total mass of the lubricating oil composition, it is usually 0.5 mass % or less in terms of metal element. However, it is preferable to adjust the content of the metallic detergent with other additives so that the sulfuric acid ash content in the composition becomes 1.0 mass % or less, based on the total mass of the composition. In such a viewpoint, the content of the metallic detergent, to the total mass of the composition, is preferably 0.3 mass % or less, and more preferably 0.23 mass % or less in terms of metal element. Further, the lower limit of the content of the metallic detergent is preferably 0.01 mass % or more, more preferably 0.02 mass % or more, and still more preferably 0.15 mass % or more. When the content of the metallic detergent is less than 0.01 mass %, it is difficult to ensure the high-temperature detergency, oxidation stability, and long-drain performance such as base number retention, which is thus unfavorable.

The lubricating oil composition of the second aspect of the present invention may comprise various additives described below, in addition to the above described components.

(Ashless Dispersant)

Moreover, the lubricating oil composition of the second aspect of the present invention preferably further comprises an ashless dispersant. The same ashless dispersants as those described in the lubricating oil composition of the first aspect of the present invention may be used.

(Chain-Terminating Antioxidant)

Additionally, the lubricating oil composition of the second aspect of the present invention preferably still further comprises a chain-terminating antioxidant. This helps to improve the antioxidant property of the lubricating oil composition, thus enabling improvement of the base number retention and high-temperature detergency.

The same chain-terminating antioxidants as those described in the lubricating oil composition of the first aspect of the present invention may be used.

(Conventional Additives)

The lubricating oil composition of the second aspect of the present invention may contain any kind of additives generally used for a lubricating oil depending on the purposes, in order to further enhance its performance. Examples of such additives include: an anti-wear agent, friction modifier, viscosity index improver, corrosion inhibitor, rust inhibitor, demulsifier, metal deactivator, defoamant, and coloring agent. Each of these additives may be the same as those described in the first aspect of the present invention.

When adding these additives to the lubricating oil composition of the second aspect of the invention, the content of each of the corrosion inhibitor, the rust inhibitor, and the demulsifier, to the total mass of the lubricating oil composition, is usually 0.005 mass % or more and 5 mass % or less; the content of the metal deactivator, to the total mass of the lubricating oil composition, is usually 0.005 mass % or more and 1 mass % or less; and the content of the defoamant, to the total mass of the lubricating oil composition, is usually 0.0005 mass % or more and 1 mass % or less.

(Kinematic Viscosity of the Lubricating Oil Composition of the Second Aspect of the Present Invention)

The kinematic viscosity at 100° C. of the lubricating oil composition of the second aspect of the present invention is 4.1 $mm^2/s$ or more and 21.9 $mm^2/s$ or less, preferably 5.6 $mm^2/s$ or more and 16.3 $mm^2/s$ or less, and more preferably 5.6 $mm^2/s$ or more and 12.5 $mm^2/s$ or less.

(Sulfur Content of the Lubricating Oil Composition of the Second Aspect of the Present Invention)

The sulfur content of the lubricating oil composition of the second aspect of the present invention, to the total mass of the lubricating oil composition, is preferably 0.3 mass % or less, more preferably 0.2 mass % or less, and still more preferably 0.1 mass % or less. By setting the sulfur content at the above upper limit or less, it is possible to realize a low-sulfur lubricating oil composition with an excellent long-drain performance.

The total phosphorus concentration in the lubricating oil composition of the second aspect of the present invention is preferably 0.005 mass % or more and 0.12 mass % or less, more preferably 0.03 mass % or more and 0.11 mass % or less, and still more preferably 0.05 mass % or more and 0.105 mass % or less in terms of phosphorus, based on the total of mass of the lubricating oil composition. If the phosphorus concentration in the lubricating oil composition exceeds the above upper limit, poisoning of an exhaust gas purifying catalyst tends to be brought about.

(Uses of the Lubricating Oil Composition of the Second Aspect of the Present Invention)

The lubricating oil composition of the second aspect of the present invention is capable of maintaining its anti-wear property and also enables sulfur content reduction and excellent friction reduction to be compatible. As such, it can be favorably used as a lubricating oil composition for internal combustion engines such as gasoline engine, diesel engine, and gas engine for motorcycles, automobiles, power generation, and ships. Furthermore, it can also be suitably used as a lubricating oil required to exhibit an anti-wear performance and long-drain performance, for example as a lubricant oil for drive systems such as automatic and manual transmissions, and a lubricating oil such as wet brake oil, hydraulic oil, turbine oil, compressor oil, bearing oil, and refrigerator oil.

EXAMPLES

First Aspect of the Present Invention

Hereinafter, the first aspect of the present invention will be described in specific based on Examples and Comparative Examples; however, the present invention is not limited to the below Examples.

(1) Friction Reduction Effect of the First Metal Salt of the Phosphorus Compound

Examples 1 to 3, Comparative Examples 1 to 4

In Examples 1 to 3 and Comparative Examples 1 to 4, the friction reduction effects of the compositions were evaluated, each of the compositions containing a polyα-olefin having a kinematic viscosity at 100° C. of 2.0 $mm^2/s$ as a base oil, and containing a different phosphorus compound metal salt in an amount of 0.10 mass % in terms of phosphorus as shown in Table 1. The results are also shown in Tables 1. Evaluation of the friction coefficient was conducted with the below described block-on-ring test. The "mass %" in Table 1 is a value based on the total mass of the composition.

(Block-on-Ring Test)

The block-on-ring test was conducted in accordance with ASTM D3701, D2714. The test conditions were set such that the load was 445N, the oil temperature was 100° C., and the slip velocity was as indicated in Table 1.

TABLE 1

| | | Example 1 | Example 2 | Example 3 | Comparative Example 1 | Comparative Example 2 | Comparative Example 3 | Comparative Example 4 |
|---|---|---|---|---|---|---|---|---|
| Lubricant base oil ※1) | | Remainder | Remainder | Remainder | Remainder | Remainder | Remainder | Remainder |
| (A) Phosphorus compound ※2) | mass % | 1.16 | — | — | — | — | — | — |
| in terms of phosphorus | mass % | (0.10) | — | — | — | — | — | — |
| (A) Phosphorus compound ※3) | mass % | — | 1.16 | — | — | — | — | — |
| in terms of phosphorus | mass % | — | (0.10) | — | — | — | — | — |
| (A) Phosphorus compound ※4) | mass % | — | — | 1.16 | — | — | — | — |
| in terms of phosphorus | mass % | — | — | (0.10) | — | — | — | — |
| Phosphorus compound ※5) | mass % | — | — | — | 1.13 | — | — | — |
| in terms of phosphorus | mass % | — | — | — | (0.10) | — | — | — |
| Phosphorus compound ※6) | mass % | — | — | — | — | 1.25 | — | — |
| in terms of phosphorus | mass % | — | — | — | — | (0.10) | — | — |
| Phosphorus compound ※7) | mass % | — | — | — | — | — | 1.16 | — |

TABLE 1-continued

| | | Example 1 | Example 2 | Example 3 | Comparative Example 1 | Comparative Example 2 | Comparative Example 3 | Comparative Example 4 |
|---|---|---|---|---|---|---|---|---|
| in terms of phosphorus | mass % | — | — | — | — | — | (0.10) | — |
| Phosphorus compound ※8) | mass % | — | — | — | — | — | — | 1.16 |
| in terms of phosphorus | | — | — | — | — | — | — | (0.10) |
| Total phosphorus content (to the total mass of the composition) | mass % | 0.10 | 0.10 | 0.10 | 0.10 | 0.10 | 0.10 | 0.10 |
| Total sulfur content (to the total mass of the composition) | mass % | 0.05 | 0.05 | 0.05 | 0.00 | 0.21 | 0.05 | 0.05 |
| Friction coefficient (Block-on-ring test) | | | | | | | | |
| Velosity: 1000 mm/s | | 0.129 | 0.129 | 0.13 | 0.132 | 0.139 | 0.136 | 0.148 |
| Velosity: 750 mm/s | | 0.129 | 0.129 | 0.13 | 0.134 | 0.141 | 0.138 | 0.154 |
| Velosity: 500 mm/s | | 0.131 | 0.131 | 0.132 | 0.136 | 0.144 | 0.141 | 0.158 |
| Velosity: 200 mm/s | | 0.13 | 0.13 | 0.131 | 0.138 | 0.147 | 0.144 | 0.168 |
| Velosity: 100 mm/s | | 0.13 | 0.13 | 0.131 | 0.138 | 0.147 | 0.144 | 0.17 |
| Velosity: 50 mm/s | | 0.128 | 0.128 | 0.129 | 0.136 | 0.145 | 0.142 | 0.171 |

1) Polyα-olefin, kinematic viscosity at 100° C.: 2.0 $mm^2/s$.
2) Zinc salt of di-n-octyl monothiophosphate and di-n-octylphosphate, phosphorus content: 8.6 mass %, sulfur content: 4.4 mass %, zinc content: 8.8%
3) Zinc salt of di-n-butylphosphate and di-n-dodecylmonothiophosphate, phosphorus content: 8.6 mass %, sulfur content: 4.4 mass %, zinc content: 8.8%
4) Zinc salt of di-n-butylmonothiophosphate and di-n-dodecylphosphate, phosphorus content: 8.6 mass %, sulfur content: 4.4 mass %, zinc content: 8.8%
5) Zinc di-n-octylphosphate, phosphorus content: 8.8 mass %, sulfur content: 0 mass %, zinc content: 9.1%
6) Zinc di-n-octyldithiophosphate, phosphorus content: 8.0 mass %, sulfur content: 16.6 mass %, zinc content: 8.3%
7) Zinc salt of di-n-octyldithiophosphate and di-n-octylphosphate, phosphorus content: 8.6 mass %, sulfur content: 4.4 mass %, zinc content: 8.8%
8) Zinc salt of di-2ethylhexylthiophosphate and di-2ethylhexylphosphate, phosphorus content: 8.6 mass %, sulfur content: 4.4 mass %, zinc content: 8.8%

(2) Evaluation of the Anti-Wear Property of the Composition

Example 4, Comparative Examples 5 and 6

Compositions were prepared, each containing a mineral base oil, a metal salt of a phosphorus compound, and other additives as shown in Table 2; and the anti-wear properties of the compositions were evaluated. The results are also shown in Table 2. Evaluation of the anti-wear property was conducted with the below KA24E Valve train wear test.

(KA24E Valve Train Wear Test)

The KA24E Valve train wear test was conducted in accordance with JASO M328-95.

| | | Example 4 | Comparative Example 5 | Comparative Example 6 |
|---|---|---|---|---|
| Lubricant base oil ※1) | mass % | Remainder | Remainder | Remainder |
| Phosphorus compound ※2) | mass % | 0.8 | — | — |
| in terms of phosphorus | mass % | (0.07) | — | — |
| Zinc dialkyl phosphate ※3) | mass % | — | 0.8 | — |
| in terms of phosphorus | mass % | — | (0.07) | — |
| Zinc dialkyl dithiophosphate ※4) | mass % | — | — | 0.97 |
| in terms of phosphorus | mass % | — | — | (0.07) |
| Metallic detergent ※5) | mass % | 3.3 | 3.3 | 3.3 |
| in terms of metal | mass % | (0.2) | (0.2) | (0.2) |
| Ashless dispersant ※6) | mass % | 5 | 5 | 5 |
| Antioxidant ※7) | mass % | 0.5 | 0.5 | 0.5 |
| Viscosity index improver ※8) | mass % | 7 | 7 | 7 |
| demusifier ※9) | mass % | 0.01 | 0.01 | 0.01 |
| Total phosphorus content (to the total mass of the composition) | mass % | 0.07 | 0.07 | 0.07 |
| Total sulfur content (to the total mass of the composition) | mass % | 0.04 | 0.01 | 0.15 |
| KA24E Valve train wear test | | | | |
| Cam wear amount | μm | 6.3 | 26.6 | 13.3 |

※1) Total aromatic content: 1.2 mass %, sulfur content: 10 mass ppm, kinematic viscosity at 100° C.: 5.6 $mm^2/s$, viscosity index: 125
※2) Zinc salt of di-n-octylmonothiophosphate and di-n-octylphosphate, phosphorus content: 8.6 mass %, sulfur content: 4.4 mass %, zinc content: 8.8%
※3) Alkyl group: n-octyl group, phosphorus content: 8.8 mass %, sulfur content: 0 mass %, zinc content: 9.1%
※4) Alkyl group: sec-butyl/sec-hexyl group, phosphorus content: 7.2 mass %, sulfur content: 15.2 mass %, zinc content: 7.8%
※5) Calcium salicylate, total base number: 170 mgKOH/g, calcium content: 6.0 mass %
※6) Polybutenyl succinimide, number average molecular weight of polybutenyl group: 1300
※7) Amine-based antioxidant
※8) OCP, weight average molecular weight: 150,000
※9) Polyalkylene glycol-based It was found from the results shown in Table 1 that the lubricating oil compositions of Examples 1 to 3 wherein a linear dialkyl monothiophosphate zinc salt was used exhibited lower friction coefficients and more excellent fuel saving performances in all conditions, compared with Comparative Example 1 wherein zinc dialkyl phosphate was used, Comparative Examples 2 and 3 wherein zinc dialkyl dithiophosphate was used, and Comparative Example 4 wherein a branched dialkyl monothiophosphate zinc salt was used.

It was found from the results shown in Table 2 that the composition of Example 4 wherein a linear dialkyl monothiophosphate zinc salt was used excelled in the anti-wear performance, compared with Comparative Example 5 wherein zinc dialkyl phosphate was used and Comparative Example 6 wherein branched zinc dialkyl dithiophosphate was used.

Second Aspect of the Present Invention

Hereinafter, the second aspect of the present invention will be described in specific based on Examples and Comparative Examples; however, the present invention is not limited to the below Examples.

Examples 5 to 7, Comparative Examples 7 to 9, Reference Examples 10 and 11

In Examples 5 to 7, Comparative Examples 7 to 9, and Reference Examples 10 and 11, compositions were prepared, each containing a mineral base oil, a different metal salt of a phosphorus compound in an amount of 0.07 mass % in terms of phosphorus, and a metallic detergent in an amount of 0.2 mass % in terms of metal as shown in Table 3. The friction reduction effects of these compositions were evaluated by conducting the below block-on-ring test; and the anti-wear properties of these compositions were evaluated by conducting the KA24E Valve train wear test. The results are also shown in Table 3.

(Block-on-Ring Test)

The block-on-ring test was conducted in accordance with ASTM D3701, D2714, with the test conditions of the load being 445N, the oil temperature being 100° C., and the slip velocity indicated Table 1.

(KA24E Valve Train Wear Test)

The KA24E Valve train wear test was conducted in accordance with JASO M328-95.

TABLE 3

| | | Example 5 | Example 6 | Example 7 | Comparative Example 7 | Comparative Example 8 | Comparative Example 9 | Reference Example 10 | Reference Example 11 |
|---|---|---|---|---|---|---|---|---|---|
| Lubricant base oil ※1) | mass % | Remainder | Remainder | Remainder | Remainder | Remainder | Remainder | Remainder | Remainder |
| (A) Zinc dialkyl thiophosphate ※2) | mass % | 0.8 | — | — | — | — | — | — | — |
| in terms of phosphorus | mass % | (0.07) | — | — | — | — | — | — | — |
| (A) Zinc dialkyl thiophosphate ※3) | mass % | — | 0.8 | 0.8 | — | — | — | 0.8 | 0.8 |
| in terms of phosphorus | mass % | — | (0.07) | (0.07) | — | — | — | (0.07) | (0.07) |
| (A) Zinc dialkyl thiophosphate ※4) | mass % | — | — | — | 0.8 | — | — | — | — |
| in terms of phosphorus | mass % | — | — | — | (0.07) | — | — | — | — |
| Zinc dialkyl phosphate ※5) | mass % | — | — | — | — | 0.8 | — | — | — |
| in terms of phosphorus | mass % | — | — | — | — | (0.07) | — | — | — |
| Zinc dialkyl dithiophosphate ※6) | mass % | — | — | — | — | — | 0.97 | — | — |
| in terms of phosphorus | mass % | — | — | — | — | — | (0.07) | — | — |
| (B) Metallic detergent ※7) | mass % | 3.3 | 3.3 | — | 3.3 | 3.3 | 3.3 | — | — |
| in terms of metal | mass % | (0.2) | (0.2) | — | (0.2) | (0.2) | (0.2) | — | — |
| (B) Metallic detergent ※8) | mass % | — | — | 1.8 | — | — | — | — | — |
| in terms of metal | mass % | — | — | (0.2) | — | — | — | — | — |
| Metallic detergent ※9) | mass % | — | — | — | — | — | — | 1.8 | — |
| in terms of metal | mass % | — | — | — | — | — | — | (0.2) | — |
| Metallic detergent ※10) | mass % | — | — | — | — | — | — | — | 2.2 |
| in terms of metal | mass % | — | — | — | — | — | — | — | (0.2) |
| Ashless dispersant ※ 11) | mass % | 5 | 5 | 5 | 5 | 5 | 5 | 5 | 5 |
| Antioxidant ※12) | mass % | 1 | 1 | 1 | 1 | 1 | 1 | 1 | 1 |
| Viscosity index improver ※13) | mass % | 7 | 7 | 7 | 7 | 7 | 7 | 7 | 7 |
| demusifier ※14) | mass % | 0.01 | 0.01 | 0.01 | 0.01 | 0.01 | 0.01 | 0.01 | 0.01 |
| Total phosphorus content (to the total mass of the composition) | mass % | 0.07 | 0.07 | 0.07 | 0.07 | 0.07 | 0.07 | 0.07 | 0.07 |
| Total sulfur content (to the total mass of the composition) | mass % | 0.08 | 0.08 | 0.1 | 0.08 | 0.01 | 0.15 | 0.1 | 0.12 |
| Friction coefficient (Block-on-ring test) | | | | | | | | | |
| Velosity: 1000 mm/s | | 0.091 | 0.092 | 0.093 | 0.093 | 0.093 | 0.102 | 0.116 | 0.114 |
| Velosity: 750 mm/s | | 0.091 | 0.092 | 0.094 | 0.095 | 0.094 | 0.103 | 0.118 | 0.116 |
| Velosity: 500 mm/s | | 0.09 | 0.091 | 0.094 | 0.097 | 0.093 | 0.104 | 0.121 | 0.117 |
| Velosity: 200 mm/s | | 0.09 | 0.091 | 0.092 | 0.095 | 0.092 | 0.105 | 0.122 | 0.118 |

TABLE 3-continued

| | | Example 5 | Example 6 | Example 7 | Comparative Example 7 | Comparative Example 8 | Comparative Example 9 | Reference Example 10 | Reference Example 11 |
|---|---|---|---|---|---|---|---|---|---|
| Velosity: 100 mm/s | | 0.088 | 0.09 | 0.09 | 0.093 | 0.09 | 0.109 | 0.122 | 0.118 |
| Velosity: 50 mm/s | | 0.087 | 0.089 | 0.087 | 0.09 | 0.086 | 0.111 | 0.12 | 0.116 |
| KA24E Valve train wear test | | | | | | | | | |
| Cam wear amount | μm | 2.4 | 6.3 | 3.5 | 5.6 | 26.6 | 15.8 | 4.8 | 6.6 |

1) Total aromatic content: 1.2 mass %, sulfur content: 10 mass ppm, kinematic viscosity at 100° C.: 5.6 $mm^2/s$, viscosity index: 125
2) Alkyl group: n-butyl and di-n-dodecyl (1:1 mol), phosphorus content: 8.4 mass %, sulfur content: 8.7 mass %, zinc content: 8.8%
3) Alkyl group: n-octyl, phosphorus content: 8.4 mass %, sulfur content: 8.7 mass %, zinc content: 8.8%
4) Alkyl group: 2 ethylhexyl, phosphorus content: 8.4 mass %, sulfur content: 8.7 mass %, zinc content: 9.1%
5) Alkyl group: n-octyl, phosphorus content: 8.8 mass %, zinc content: 7.8%
6) Alkyl group: n-octyl, phosphorus content: 8.0 mass %, sulfur content: 15.2 mass %, zinc content: 7.8%
7) Calcium salicylate having a linear α-olefin with a carbon number of nC14, nC16, nC18 as a raw material, total base number: 170 mgKOH/g, calcium content: 6.0 mass %
8) Calcium sulfonate having a linear α-olefin with a carbon number of nC20, nC22, nC24 as a raw material, total base number: 300 mgKOH/g, calcium content: 12.3 mass %
9) Calcium sulfonate having a branched olefin with a carbon number of C15 C18, C21 as a raw material, total base number: 300 mgKOH/g, calcium content: 12.3 mass %
10) Calcium phenate having a branched α-olefin with a carbon number of C12 as a raw material, total base number: 230 mgKOH/g, calcium content: 9.0 mass %.
11) Polybutenyl succinimide, number average molecular weight of polybutenyl group: 1,300
12) Phenol-based + Amine-based antioxidant (1:1)
13) OCP, weight average molecular weight: 150,000
14) Polyalkylene glycol-based It was found from the results shown in Table 3 that the compositions of Examples 5 to 7 wherein a linear dialkyl monothiophosphate zinc salt and a metallic detergent alkylated by a linear α-olefin were used exhibited lower friction coefficients, and excelled in the fuel saving performance and the anti-wear property in all conditions, compared with Comparative Example 7 wherein a branched dialkyl monothiophosphate zinc salt was used, Comparative Example 8 wherein zinc dialkyl phosphate was used, Comparative Example 9 wherein zinc dialkyl dithiophosphate was used, and Reference Examples 10 and 11 wherein metallic detergents alkylated by a branched olefin were used.

The invention has been described above as to the embodiment which is supposed to be practical as well as preferable at present. However, it should be understood that the invention is not limited to the embodiment disclosed in the specification and can be appropriately modified within the range that does not depart from the gist or spirit of the invention, which can be read from the appended claims and the overall specification, and a lubricating oil composition with such modifications is also encompassed within the technical range of the invention.

INDUSTRIAL APPLICABILITY

The lubricating oil composition of the present invention is capable of maintaining its anti-wear property and also enables sulfur content reduction and excellent friction reduction to be compatible. As such, it can be favorably used as a lubricating oil composition for internal combustion engines such as gasoline engine, diesel engine, and gas engine for motorcycles, automobiles, power generation, and ships. Further, it can also be suitably used as a lubricant oil required to have an anti-wear performance and long-drain performance, for example a lubricant oil for drive systems such as automatic and manual transmissions, and a lubricating oil such as wet brake oil, hydraulic oil, turbine oil, compressor oil, bearing oil, and refrigerator oil.

The invention claimed is:

1. A lubricating oil composition comprising:

a lubricant base oil;

0.005 to 0.12 mass % of a dialkyl monothiophosphate metal salt to the total mass of the composition in terms of phosphorus; and a metallic detergent alkylated by a linear α-olefin, wherein the dialkyl monothiophosphate metal salt is a metal salt of a phosphorus compound represented by the below formula (10)

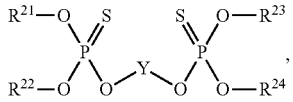

(10)

wherein $R^{21}$ to $R^{24}$ are combination of at least one $C_1$-$C_6$ linear alkyl group and at least one $C_7$-$C_{20}$ linear alkyl group, and the average carbon number of $R^{21}$ to $R^{24}$ is 5 to 9; and wherein Y is zinc.

* * * * *